US005607143A

United States Patent [19]

Regal

[11] Patent Number: 5,607,143

[45] Date of Patent: Mar. 4, 1997

[54] TREE STAND WINCH APPARATUS AND METHOD

[76] Inventor: Everet B. Regal, 313 Culvert St., Phoenix, N.Y. 13135

[21] Appl. No.: 368,557

[22] Filed: Jan. 4, 1995

[51] Int. Cl.[6] ..... B66D 1/00

[52] U.S. Cl. ..... 254/342; 254/362; 254/378

[58] Field of Search ..... 254/362, 378, 254/375, 342; 182/5, 9, 239, 240, 75

[56] References Cited

U.S. PATENT DOCUMENTS

| | | | |
|---|---|---|---|
| 484,042 | 10/1892 | Murphy et al. | 182/240 |
| 678,169 | 7/1901 | Firth . | |
| 1,125,107 | 1/1915 | Jacques | 254/378 |
| 2,495,811 | 1/1950 | Hollmann | 254/342 |
| 2,647,703 | 8/1953 | Hayes | 242/107 |
| 3,165,297 | 1/1965 | Thompson, III et al. | 254/344 |
| 3,306,582 | 2/1967 | Copeland | 182/240 |
| 4,951,778 | 8/1990 | Halvorson | 182/9 |
| 4,962,901 | 10/1990 | Shirley | 242/250 |
| 5,176,365 | 1/1993 | Best | 254/342 |
| 5,394,815 | 3/1995 | Hansen | 242/250 |
| 5,474,278 | 12/1995 | Cleveland | 254/334 |

*Primary Examiner*—Katherine Matecki
*Attorney, Agent, or Firm*—Thomas, Kayden, Horstemeyer & Risley

[57] ABSTRACT

A tree stand winch (10) for hoisting items from ground level up to a desired height within a tree or pole comprising a crank wheel (12) having both a hand knob (14) and a power tool adapter (16) mounted thereto for actuating a gear assembly (20). Crank wheel (12) is mounted to one surface of a support plate (28) and mounted to the opposite surface of the support plate (28) is a line spool (30) which rotates in response to the actuation of the gear assembly (20). Additionally, secured to the support plate (28) is a brake and drag mechanism (50) for providing variable resistance to the rotation of the line spool (30). The winch (10) is secured to a user's belt by an attachment mechanism (90) while the user ascends a tree or pole. Once positioned up the tree or pole, the user secures the winch (10) to the tree or pole by the attachment mechanism (90). The winch (10) is stabilized during use by a stabilizer mechanism (70) including at least two cleats (75) which engage the tree in a straddling arrangement and a stabilizer bar (80) which is strapped to the tree or pole.

16 Claims, 6 Drawing Sheets

TREE STAND WINCH APPARATUS AND METHOD

INTRODUCTION

1. Field of the Invention

The present invention generally relates to a tree stand winch, and more particularly, to a portable tree stand winch apparatus and method for hoisting a deer hunter's gear, such as the hunter's tree stand, rifle, bow or duffle bag, from ground level to the upper portion of the tree where the hunter resides.

BACKGROUND OF THE INVENTION

In recent years, hunting wild game has become an ever popular sport as evidenced by the number of syndicated and local hunting shows televised weekly. Of the various types of game hunted for sport, deer hunting is one of the most popular and widespread.

The most common method for hunting deer today entails the use of a tree stand which the hunter uses to position himself in a tree between ten and thirty feet above the ground. In the tree stand, the hunter enjoys a greater view of the surrounding terrain in addition to having a substantially decreased chance of being spotted or scented by the deer.

Conventional tree stands are either assembled at the desired height within the tree once the hunter has climbed the tree, referred to as a wrap-around tree stand, or the tree stand itself is used by the hunter to climb the tree, referred to as a climber tree stand. Illustrative of a climber tree stand is U.S. Pat. No. 5,234,077 to Sheriff. Climber tree stands such as the one disclosed in Sheriff comprise dual frames, a top frame having a seat and a bottom frame for a foot rest. In operation, the two frames are used to climb up or down a tree by resting on the top frame and lifting the bottom frame and securing it to the tree just below the top frame. Then, raising the top frame to a next higher position and repeating. Alternatively, wrap-around tree stands require the hunter to climb the tree by either using spiked climbing boots or screwing spikes into the tree which the hunter uses to climb up the tree. Once the hunter has climbed to a desired height above the ground, he retrieves his hunting stand from the ground so that he may assemble it in the tree.

Because of the physical demands, it is often too difficult and dangerous for the hunter using a climber tree stand to carry his rifle, bow, duffle bag or other items with him as he ascends or descends a tree. Consequently, the hunter must leave his rifle, bow or duffle bag on the ground at the base of the tree and retrieve his gear once positioned in the tree stand. Presently, hunters typically use a clothes line or other light weight rope having sufficient strength to hoist their gear up to the tree stand. Typically, the hunter ties one end of the rope around his gear and carries the other end up into the tree as he climbs up into the tree. Once secured in the tree stand at the desired height, the hunter hoists his gear hand over hand up into the tree. This method, however, imposes several disadvantages. First, the hunter's gear may be quite heavy and lifting it ten to thirty feet while situated on a somewhat unstable tree stand is not only difficult but often times dangerous. Secondly, lifting the gear hand over hand may be difficult on a cold or rainy day where there is a substantial chance of the rope slipping. Lastly, carrying around and storing the loose rope may impose problems because rope or line may become tangled to such a degree that the rope cannot be used to hoist or lower the hunter's gear.

Similarly, the hunter using a wrap-around tree stand must retrieve his stand from the ground once he has climbed up the tree to a desired height. Again, this is usually accomplished by tieing a rope or line to the tree stand and hoisting it up by hand into the tree. This is a substantial task in that most tree stands weigh between sixteen and thirty-five pounds, depending upon the tree stand's design and weight capacity.

Accordingly, it can be seen that it would be desirable to provide a tree stand winch apparatus and method for hoisting a hunter's tree stand, rifle, bow or duffle bag from the ground up into the tree where the hunter resides, and which is easy to use and provides the hunter with lifting power.

SUMMARY OF THE INVENTION

Briefly described, the present invention comprises a tree stand winch which can be connected to the belt of a deer hunter as the hunter climbs a tree, and which can be connected high in the tree and used to hoist the hunter's gear from the ground up to the position of the hunter once in the tree. The winch includes a crank wheel for actuating a gear assembly mounted to a support plate. Also mounted to the support plate is a line spool actuated by the gear assembly. Additionally, secured to the support plate and actionable on the line spool is a brake and drag mechanism for providing variable resistance to the rotation of the line spool. The winch can be secured to a user's belt via a swivel hook or other equivalent attaching mechanism secured to the winch at the support plate. The winch can also be attached to a tree by securing the swivel hook to the user's body strap which is wrapped around the tree for stabilizing the winch while in operation. Further, cleats are provided which extend from the support plate and removably engage the tree in a straddling arrangement. For additional support a stabilizer bar which extends downwardly from the support plate can be secured to the tree so as to prevent the winch from pivoting or moving away from the tree. Additionally, the present invention can be manually operated using a hand knob on the crank wheel or power operated using a portable battery powered tool in conjunction with a hex adapter on the crank wheel.

A second embodiment of the present invention is a tree stand winch that integrates the gear assembly with the line spool, thereby reducing the number of parts which results in reduced manufacturing cost.

A third embodiment of the present invention is a tree stand winch comprising two parallel support plates having the line spool rotatably mounted therebetween. The addition of a second support plate provides greater balance and stability to the tree stand winch, removing the necessity of a stabilizer bar.

The present invention can also be viewed as a novel method for efficiently and safely hoisting objects from the ground up into a tree. In this sense, the present invention involves the following method steps. One step is securing the winch to a convenient position on the user, typically the user's belt. Another step is to pay out a portion of the line contained on the line spool of the winch and securing an end of the line to the objects which are to be hoisted from the ground up into the tree. Once the user has climbed the tree to the desired height, another step is removing the winch from the user and securing the winch to the tree by an attachment mechanism such as the swivel hook which can be attached to the user's body strap wrapped around the tree. Another step is to actuate the wheel crank of the winch so that the spool begins to reel in the objects. Finally, another step is to brake the movement of the line spool via a brake and drag mechanism once the user's gear has been hoisted to a desired position.

A feature of the present invention is that a hex adapter can be utilized in conjunction with the wheel crank of the winch for coupling a battery powered tool such as a power screwdriver to the winch to provide power operation of the winch.

An advantage of the present invention is that it provides a tree stand winch apparatus which is light weight, inexpensive and compact, making its use convenient to a person climbing a tree or pole.

Another advantage of the present invention is that it provides a tree stand winch which provides the user with lifting power, and thereby enabling them to lift heavy items in a safe manner.

Another advantage of the present invention is that it provides a tree stand winch that can be mounted to a tree quickly and easily by merely securing the attaching mechanism of the winch to the user's body strap.

Other objects, features and advantages of the present invention will become apparent from the following description when considered in conjunction with the accompanying drawings.

BRIEF DESCRIPTION OF THE DRAWINGS

The present invention, as defined in the claims, can be better understood with reference to the following drawings. The drawings are not necessarily to scale, emphasis being placed upon clearing illustrating the principles of the present invention.

DETAILED DESCRIPTION OF THE PREFERRED EMBODIMENT

A preferred embodiment of the present invention is described below in the context of a hunter using a winch in accordance with the present invention to lift and lower the hunter's gear, such as a tree stand, rifle, bow or duffle bag, from the ground up into a tree where the hunter resides. However, it can be appreciated by those skilled in the art that a winch configured in accordance with the present invention may also find application for use by a telephone repair person, cable company repair person, power company repair person, or a like repair person who is required to ascend a telephone or power line pole in the scope of their daily work and would have need to retrieve heavy or cumbersome objects from the ground once they have ascended the tree or pole.

Figure 1:
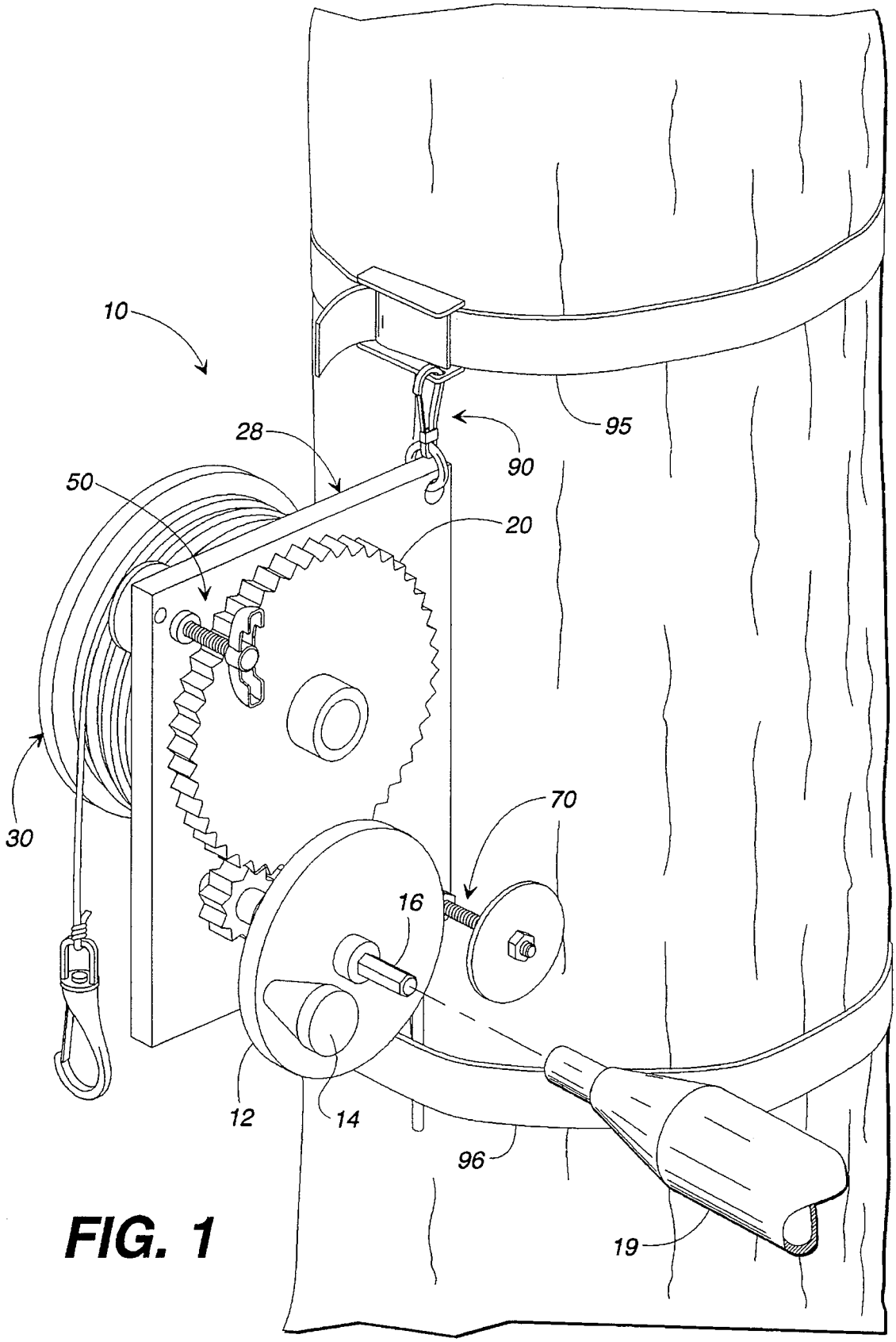
FIG. 1 is a front perspective view of a tree stand winch in accordance with the present invention.
Figure 2:
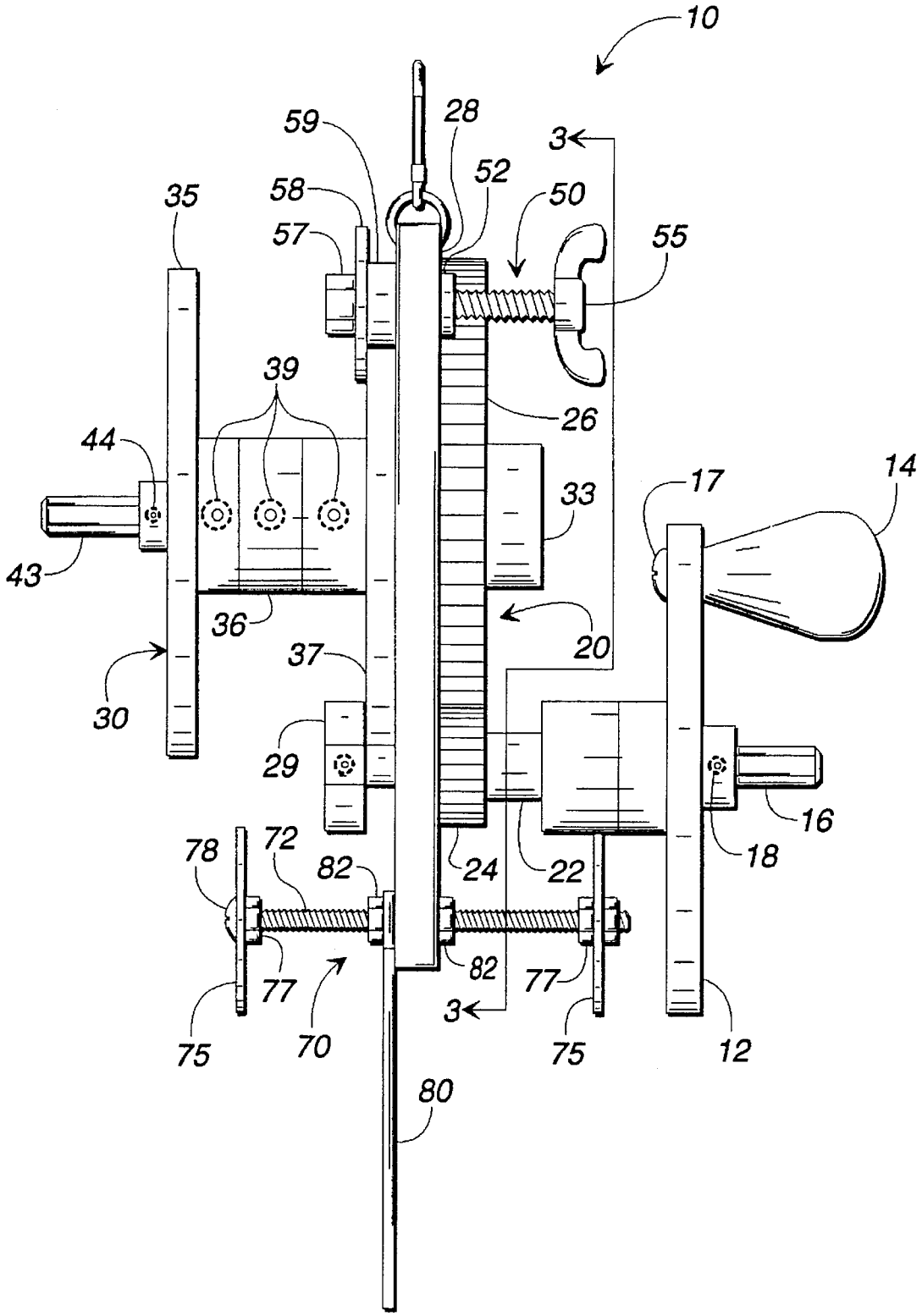
FIG. 2 is a side elevational view of the tree stand winch of FIG. 1.

With reference to the drawings wherein like reference numerals represent corresponding parts throughout the several views, FIGS. 1 and 2 illustrate views of a tree stand winch apparatus 10 in accordance with the preferred embodiment of the present invention. The winch 10 is configured to retrieve the belongings of a hunter from the ground when the hunter resides in the upper portion of a tree. The winch 10 is compact in design and is constructed out of light weight material so that its presence is hardly noticeable when attached to the hunter while climbing the tree. Further, the tree stand winch apparatus 10 is configured in a manner so that the number of components are kept to a minimum, and therefore, the cost of manufacture is minimized.

As illustrated in FIGS. 1 and 2, winch 10 comprises a crank wheel 12 having a hand knob 14 and hex adapter 16 attached thereto for actuating winch 10. The crank wheel 12 is preferably constructed of a light weight plastic having sufficient strength to withstand the forces applied when actuating winch 10. Likewise, hand knob 14 is preferably made of a similar material. As illustrated in FIG. 2, hand knob 14 can be attached to crank wheel 12 by screw 17 or any equivalent fasting means as may be well known in the art.

The hex adapter 16 is press-fitted into crank wheel 12 and secured by tap 18. Hex adapter 16 is configured for coupling any cordless power tool to winch 10 for powered actuation of crank wheel 12. In this regard a conventional battery operated hand held screw driver 19 is suitable.

Figure 3:
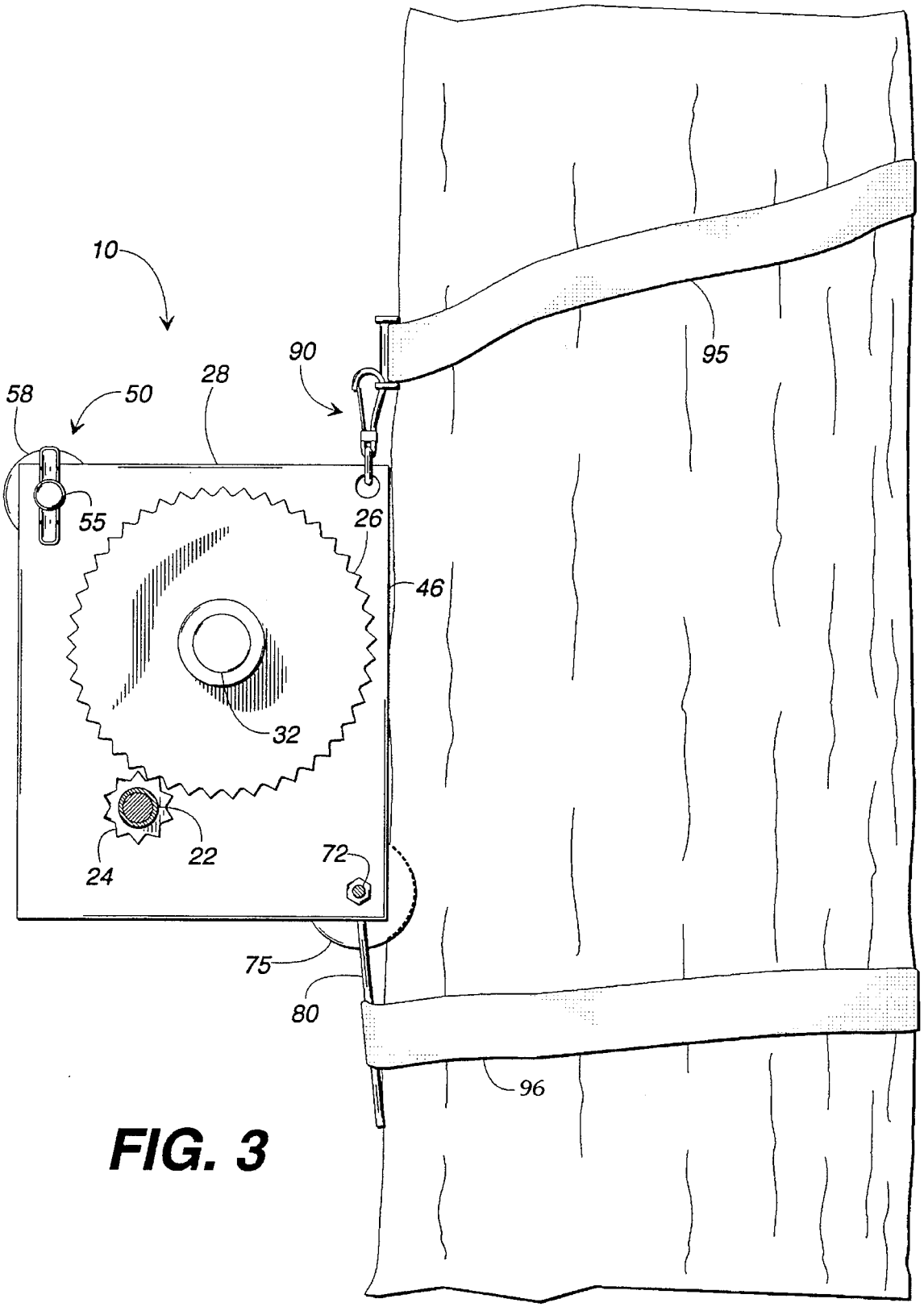
FIG. 3 is a front elevational view of the tree stand winch of FIG. 2 taken substantially along lines 3—3 in FIG. 2.

The crank wheel 12 rotates about a shaft 22, shaft 22 being made of a metal such as steel. Crank wheel 12 is in communication with gear assembly 20 via shaft 22 so that the actuation of crank wheel 12 relates to movement in gear assembly 20. Gear assembly 20 comprises a first gear 24 mated to a second gear 26 so that the gear teeth of first gear 24 and second gear 26 mesh, as illustrated in FIG. 3. It has been determined that an appropriate gear ratio for gear assembly 20 is 5:1, although it is obvious that any desirable gear ratio can be provided. Accordingly, in the preferred embodiment, gears 24, 26 are 24 pitch gears with first gear 24 having twelve teeth and second gear 26 having sixty teeth. This configuration provides the user of winch 10 with the appropriate lifting power necessary to lift relatively heavy objects from the ground level up to a desired position in the tree. As can be appreciated by one of ordinary skill in the art, gear assembly 20 can be uncovered as shown in the figures or enclosed in a gear box to protect gears 24, 26.

Figure 4:
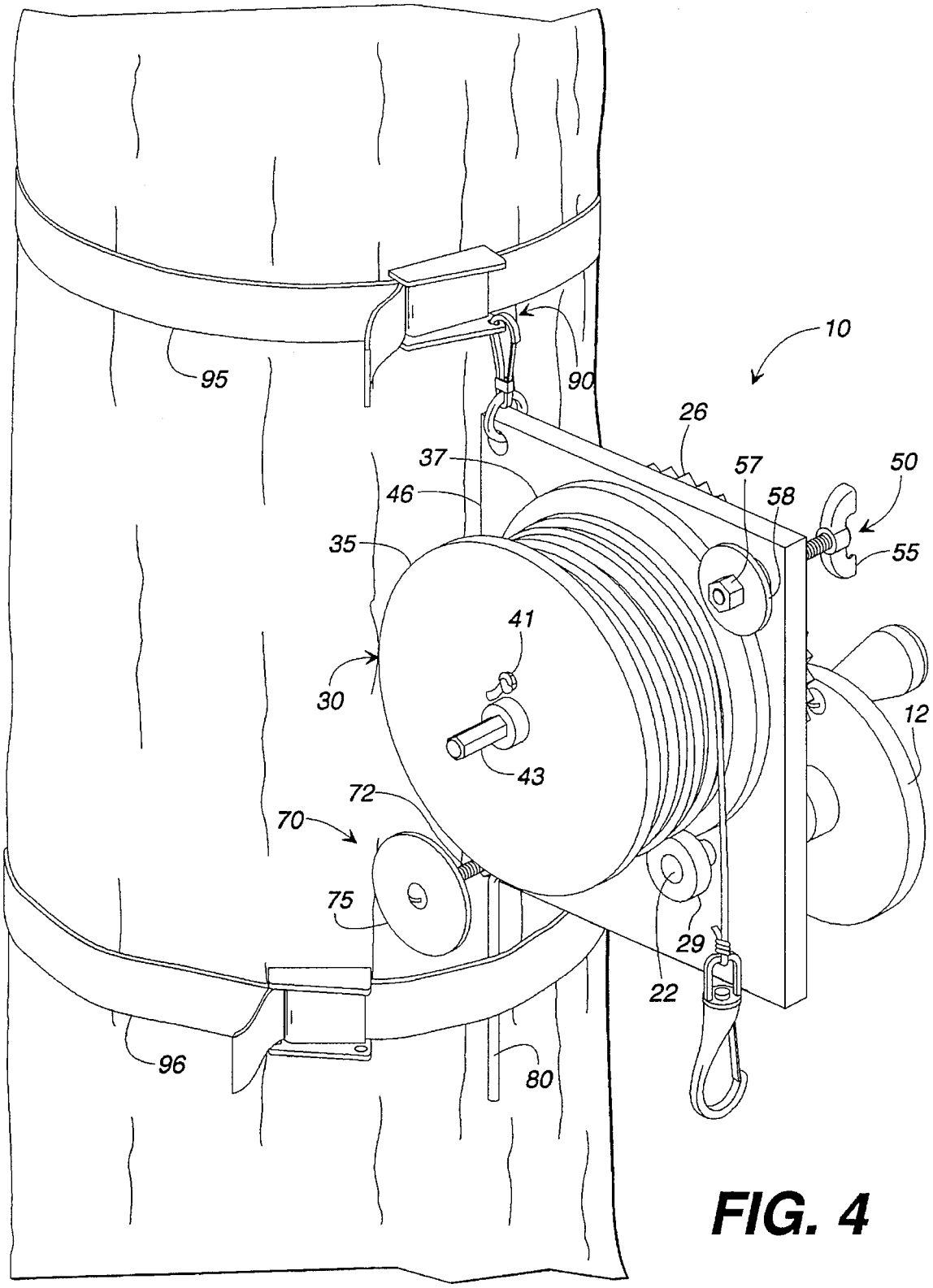
FIG. 4 is a rear perspective view of the tree stand winch of FIG. 1.

As illustrated in FIG. 2, shaft 22 extends through an appature, not shown, in a substantially flat support plate 28. Mounted to the end portion of shaft 22 which extends through support plate 28 is a collar 29 for maintaining contact between first gear 24 and second gear 26. Maintaining the space relationship between collar 29 and support plate 28 is a line spool 30, as shown in FIGS. 2 and 4. Line spool 30 is rotatably mounted to support plate 28 on a shaft 32, as shown in FIG. 3, which extends through an appature, not shown, in support plate 28. Second gear 26 is mounted to the portion of shaft 32 which extends through support plate 28 and is secured by a collar 33, shown in FIG. 2. Line spool 30 is configured for receiving a line or rope of sufficient strength for lifting the gear of a hunter. The line spool 30, as shown in FIG. 2, is a three piece modular assembly comprising a spacer 36 interposed a first end plate 35 and a second end plate 37. All three pieces are secured to shaft 22 by means such as taps 39. End plates 35, 37 are constructed of molded plastic and spacer 36 is pressed aluminum. Located on first end plate 35 is an appature 41, as shown in FIG. 4, for threadly receiving a knotted end of the line wound on line spool 30 to facilitate the loading of the line about spool 30. Mounted to line spool 30 is a second hex adapter 43 which is substantially similar in construction to hex adapter 16 and provided for power actuation line spool 30. Hex adapter 43 is provided to facilitate a more rapid retrieval of the hunter's gear by providing a 1:1 lifting ratio. Further, second hex adapter 43 is press-fitted into line spool 30 and secured by tap 44.

Figure 5:
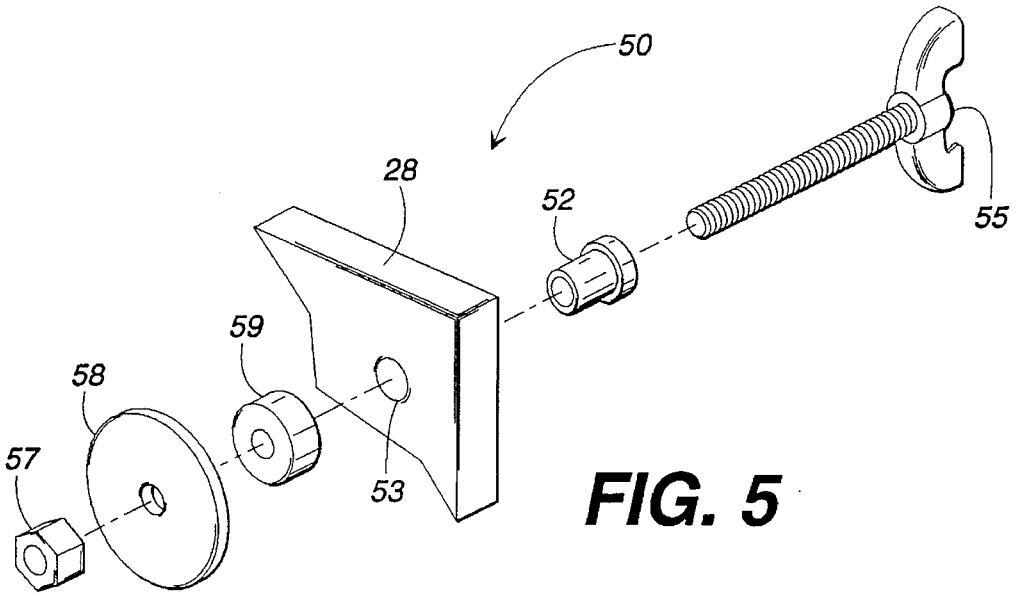
FIG. 5 is an exploded view of the braking mechanism of the tree stand winch of FIG. 1.

A brake and drag mechanism 50 is mounted to support plate 28 and configured to provide compressive resistance to end plate 37 of line spool 30. As shown in FIG. 5, braking mechanism 50 comprises a threaded insert 52 which is positioned within appature 53 of support plate 28. Threadly received in insert 52 is wing nut 55. Mounted to the end of wing nut 55 that protrudes through insert 52 are a spacer 59 sandwiched between support plate 28 and a braking plate 58. Mounted to the distal end of wing nut 55 to secure braking plate 58 and spacer 59 is lock nut 57. It can appreciated by one skilled in the art that the braking mechanism illustrated herein is illustrative of the numerous types of devices suitable for such purpose. A feature of braking mechanism 50 is the ability of the user to quickly and easily control the amount of drag provided to line spool 30 by the compressive forces of braking plate 58 controlled by wing nut 55, and likewise, the ability to completely brake and stop the movement of line spool 30.

Figure 6:
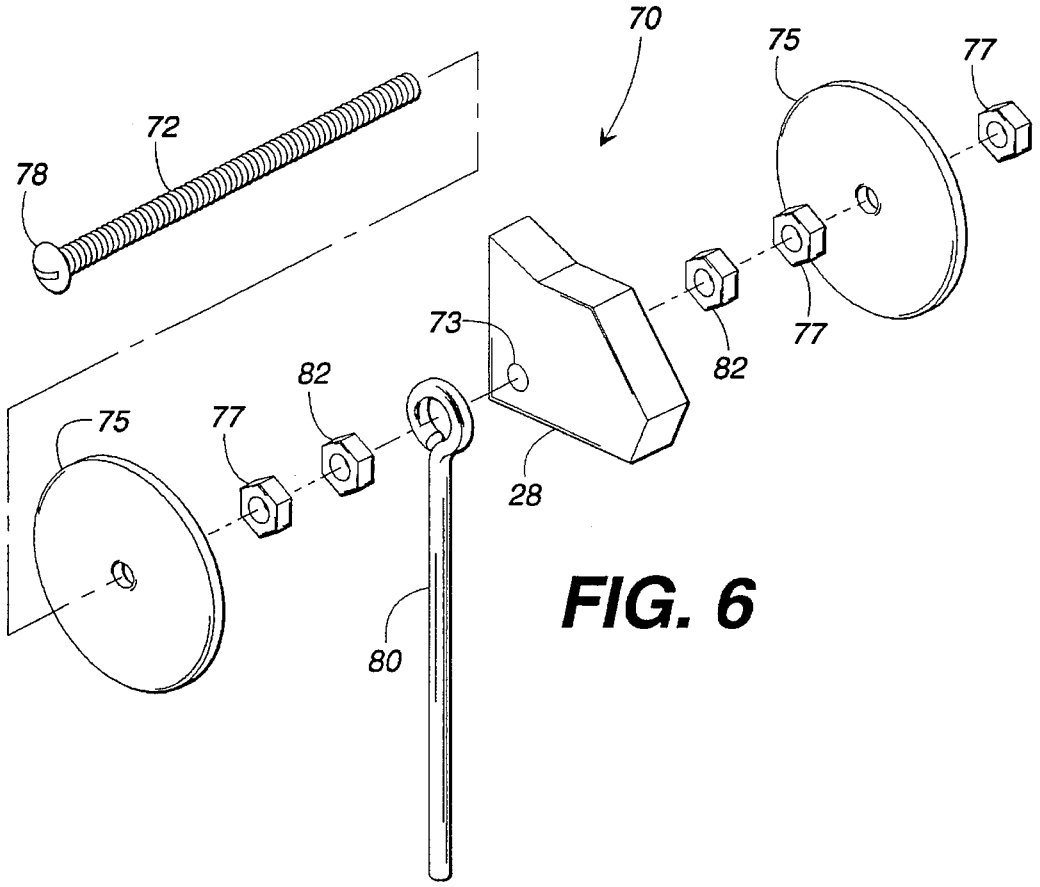
FIG. 6 is an exploded view of the stabilizing device of the tree stand winch of FIG. 1.

Provided for the purpose of stabilizing winch 10 with respect to the tree while winch 10 is in operation is stabilizing device 70, as illustrated in FIG. 6. Stabilizing device 70 includes tree engaging cleats 75 and stabilizing bar 80 for providing resistance to possible rotational or pivotal forces acting on winch 10 while in operation. Stabilizing device 70 further provides means for maintaining support plate 28 substantially at a right angle with respect to the adjacent surfaces of the tree to ensure proper operation of winch 10. In general, stabilizing device 70 comprises an elongated screw 72 which partially extends through an appature 73 in support plate 28 so that equal portions of screw 72 extend outwardly in opposite directions from support plate 28. Secured at either end of screw 72 are cleats 75 for digging or cutting into the tree's surface. Cleats 75, in the preferred embodiment, are steel discs rigidly secured by nuts 77 at the distal end of screw 72 and by screw head 78 and nut 77 and at the proximal end of screw 72 by nuts 77. Cleats 75 extend beyond the edge 46 of support plate 28 adjacent to the exterior surface of the tree for engagement with the tree in a straddling arrangement, as best seen in FIG. 3. Consequently, cleats 75 maintain support plate 28 in right angle relationship with respect to the adjacent surface of the tree.

Mounted to screw 72 and extending downwardly is stabilizer bar 80. Stabilizer bar 80 is a steel eye bolt or other similar structure. Stabilizer bar 80 is secured by nuts 82 for rigidly securing stabilizer bar 80 to support plate 28. Stabilizer bar 80, when strapped to the tree, prevents winch 10 from pivoting or moving away frown the tree. It can be well appreciated to one skilled in the art that the stabilizing device 70 illustrated herein is merely illustrative of the numerous devices which can provide the same function.

In accordance with a feature of winch 10 constructed in accordance with the present invention is an attachment mechanism 90, as shown in FIGS. 1, 3 and 4. The attachment mechanism 90 may be any suitable device such as a swivel hook as shown for purposes of illustrating the preferred embodiment. However, it can appreciated that other similar devices such as a s-hook may be utilized. A function of the attachment mechanism is to provide a quick and easy means for attaching the winch 10 to the person of a hunter while the hunter ascends or descends a tree, and for easily securing the tree stand winch to the tree for operation.

In operation, a hunter preparing to ascend a tree will secure the winch 10 to their person, preferably at the belt. An end portion of the line on line spool 30 is paid out and attached to the hunter's gear which is to subsequently be hoisted up into the tree via winch 10. The hunter, accordingly, sets an appropriated amount of drag to spool 30 via braking mechanism 50 so that line spool 30 will not freely pay out the line thereon but will allow the line to flow proportional to the distance the hunter climbs up the tree without producing resistance to the hunter's climbing. Once at the desired height in the tree, the hunter secures his body strap 95, also referred to as a lifeline, around the tree as a safety measure to catch the hunter if he were to fall. The hunter removes winch 10 from his person and attaches it to the body strap 95 by attachment mechanism 90 so that the line on line spool 30 departs from the side of line spool 30 farthest away from the tree. Brake mechanism 50 is then released allowing line spool 30 to freely rotate in response to the actuation of crank wheel 12.

When lifting objects, the downward force generated on winch 10 tends to rotate support plate 28 which drives cleats 75 into the tree's surfaces, thereby stabilizing winch 10 while in operation. Additional stability can be provided by securing stabilizer bar 80 to the tree by a jiffy strap 96 which is an elastic strap stretched around the tree and positioned over stabilizer bar 80, as shown in FIGS. 1, 3 and 4. Consequently, jiffy strap 96 secures stabilizer bar 80 from movement and further forces cleats 75 into the tree, thereby stabilizing winch 10.

In accordance with the present invention, winch 10 can be actuated to reel in or pay out line using either hand crank 14 or one of hex adapters 16, 43. Utilizing hand crank 14, the hunter is provided with the lifting power resulting from gear assembly 20 so that relatively heavy objects can be lifted with little effort, removing the danger of lifting heavy objects by the hand over hand method. Alternatively, by coupling a power screwdriver or other such device to hex adapter 16, the hunter is able to lift heavy objects from the ground while exerting essentially no physical effort. For lighter objects and a quicker retrieval of such objects, the hunter can attach a power screwdriver to hex adapter 43 for actuating winch 10.

When the items lifted by the winch 10 have reached a desired height, the hunter stops actuating winch 10 and brakes the movement of line spool 30 by actuating brake mechanism 50. This allows the hunter to secure items at the desired height so that they may be readily accessible. To lower items from their elevated position within the tree, the hunter slowly releases brake mechanism 50 allowing line spool 30 to move in reaction to the forces of gravity acting upon the hoisted objects. Thus, the hunter controls the speed of decent of such objects through operation of brake mechanism 50, or alternatively, may do so through manual operation of crank wheel 12. Once the items have reached the ground, the hunter removes winch 10 from the tree and resecures it to himself so that he may descend the tree after his belongings.

Figure 7:
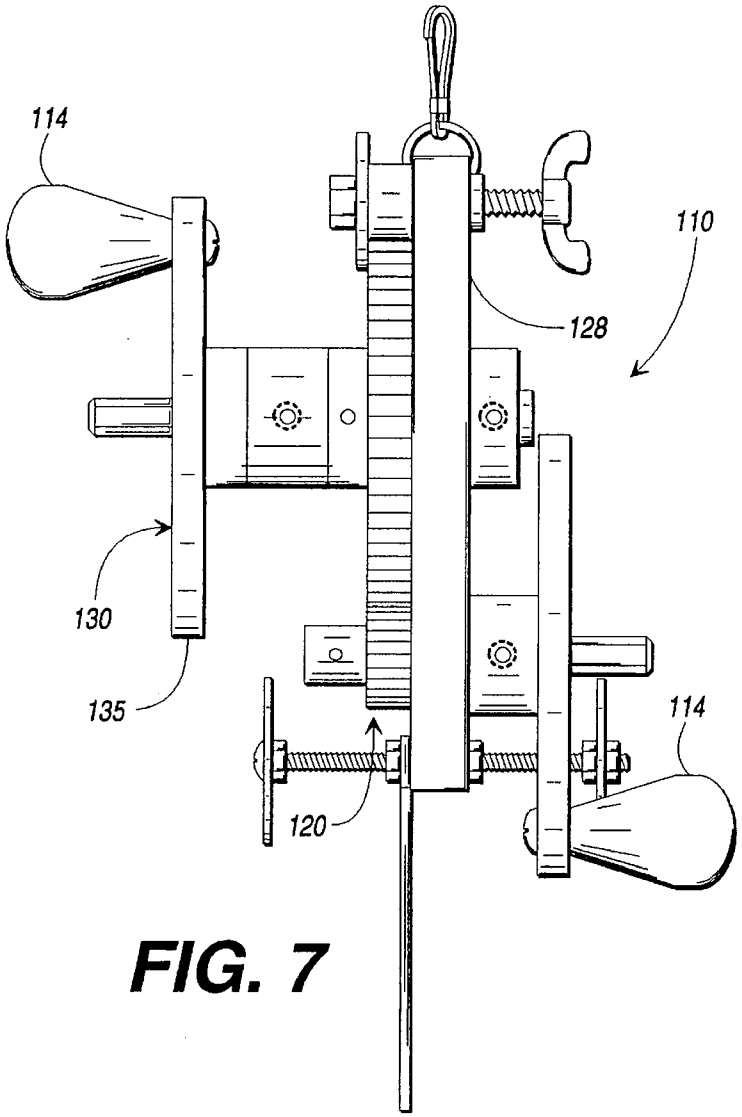
FIG. 7 is a second embodiment of a tree stand winch in accordance with the present invention.

A second embodiment of the present invention, denoted as winch 110 in FIG. 7, provides a tree stand winch comprising fewer parts which results in less expensive manufacturing cost. A noted departure from the configuration of the preferred embodiment is the integration of gear assembly 120 into line spool 130. Consequently, gear assembly 120 is positioned on the same side of support plate 128 as line spool 130, reducing the number of parts necessary to construct winch 110 in accordance with the present invention. Furthermore, an additional hand knob 114 is attached to end plate 135 of line spool 130 so that the user can manually operate winch 110 with a 1:1 lifting ratio. In all other aspects, winch 110 is configured and operates in accordance with the description of the preferred embodiment as provided herein.

Figure 8:
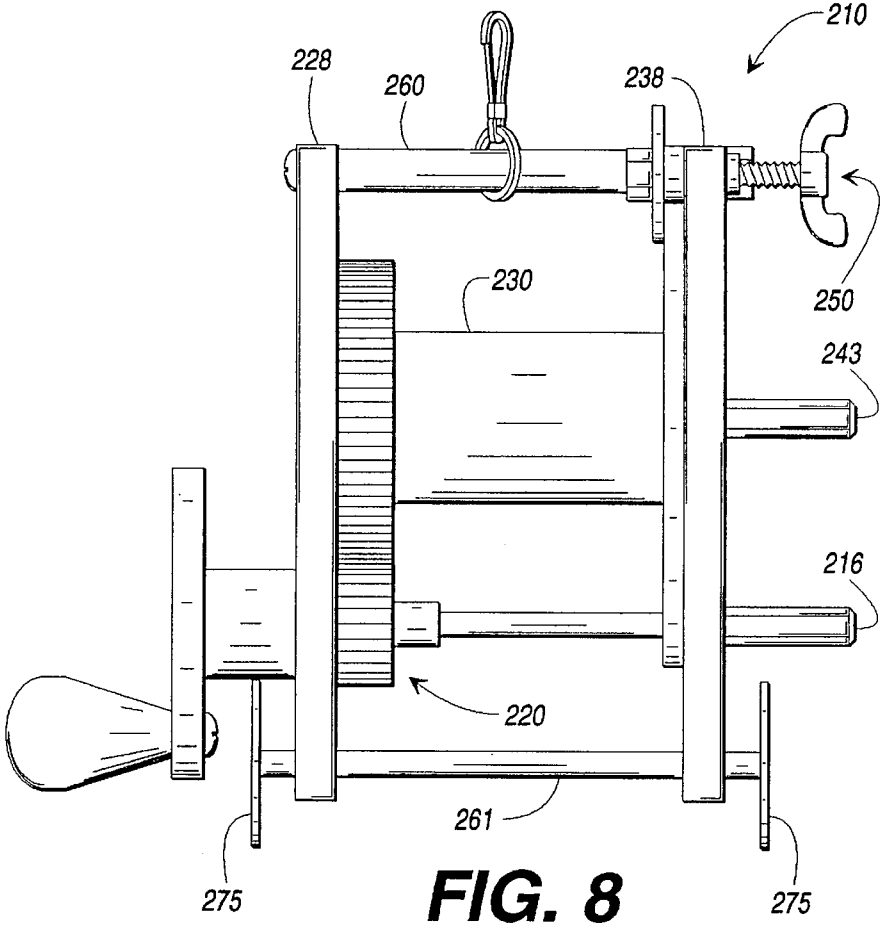
FIG. 8 is a third embodiment of a tree stand winch in accordance with the present invention.

A third embodiment of the present invention, denoted as winch 210 in FIG. 8, includes two substantially flat parallel support plates 228, 238 for providing greater balance to winch 210. Rotatably mounted between support plates 228 is line spool 230. Additionally, positioned on either side of winch 210 and spaced outwardly from support plates 228, 238 are two cleats 275. Cleats 275 extend beyond the edge of support plates 228 adjacent to the exterior of the tree engaging the tree in a straddling relationship. Support plates 228 are maintained in a space relationship by spacing rods 260, 261. Integrated into line spool 230 is gear assembly 220, thereby reducing the number of necessary parts to construct winch 210 which results in lower manufacturing cost. Because of the improved stability achieved by the addition of a second support plate, stabilizer bar 80 disclosed in the first and second embodiments of the present invention is not necessary. Winch 210 is further provided with brake mechanism 250 and hex adapters 216, 243 for actuating winch 210 with a power tool. In all other aspects, winch 210 is configured and operates in accordance with the description of the preferred embodiment as provided herein.

It will be understood by those skilled in the art that while the preferred embodiment of the present invention has been disclosed herein, numerous modifications and changes can be made thereto without departing from the spirit and scope of the present invention as set forth in the following claims.

What is claimed is:

1. A tree stand winch for mounting in a tree and for lifting and lowering a hunter's gear, comprising:

crank means for actuating said winch;

a gear assembly actuated by said crank means;

a support plate having an edge for mounting parallel to the length of the tree and having first and second opposed surfaces, said gear assembly mounted to said support plate adjacent said first surface;

a line spool mounted to said support plate, said line spool actuated by said gear assembly;

braking means attached to said support plate for braking said line spool;

attachment means for suspending said support plate from the user as the user climbs the tree, and for suspending said support plate from the tree when hoisting items; and stabilizer means attached to said support plate for simultaneously engaging the tree and securing said support plate to the tree, with the support plate extending generally upright and with its edge in engagement with the tree, said stabilizer means comprising cleat means displaced from opposite sides of said support plate for removable engagement with the tree in a straddling relationship being shaped for resisting movement of said winch about the tree, and a stabilizer bar downwardly extending from said support plate adjacent the surface of the tree, and strap means for securing said stabilizer bar to the tree.

2. The tree stand winch of claim 1 and wherein said crank means includes a crank wheel having a handle for manually cranking said winch.

3. The tree stand winch of claim 1 and wherein said crank means includes a crank wheel having an adapter for coupling a battery powered tool to said winch to provide power operation of said winch.

4. The tree stand winch of claim 1 and wherein said gear assembly includes a first smaller gear meshing with a second larger gear, said first smaller gear rotatable about the same axis of said crank and said second larger gear rotatable about the same axis of said line spool.

5. The tree stand winch of claim 1 and wherein said line spool is mounted to said second surface of said support plate.

6. The tree stand winch of claim 1 and wherein said line spool is mounted to said first surface of said support plate.

7. The tree stand winch of claim 1 and further comprising a second support plate spaced apart from and aligned substantially parallel with the first said support plate, said spool being rotatably mounted between said support plates.

8. A method for lifting a hunter's gear from the ground to a desired position in a tree, comprising the steps of:

attaching a winch device to a convenient position on a user at ground level;

paying out an end portion of the line on the winch device from the spool of the winch and attaching the end of the line to the hunter's gear to be lifted;

the user ascending the tree to a desired position;

removing the winch device from the user and securing the winch to the tree at the desired position on the tree with an attachment mechanism;

stabilizing said winch device to the tree with cleat means which engages the tree in a straddling arrangement for maintaining a support plate of the winch device in a generally upright position and substantially parallel to the length of the tree so that the winch device is stabilized from movement about the tree;

securing to the tree a stabilizer bar extending downwardly from and attached to the winch for preventing the winch from pivoting and moving away from the tree;

actuating the winch device by operating a crank wheel of the winch and reeling in the hunter's gear attached to the end of the line from the ground level up to the desired position in the tree; and braking the movement of the spool via a braking mechanism once the items have been hoisted to the desired position.

9. The method of claim 8 and wherein the step of actuating the winch includes attaching a power tool to the crank wheel and actuating the crank by operation of the power tool.

10. The method of claim 8 and wherein the step of actuating the winch includes actuating the crank wheel of the winch manually.

11. A tree stand winch for mounting in a tree and for lifting and lowering a hunter's gear, comprising:

a spool having a line wound thereon;

support means including a support plate for mounting parallel to the length of the tree, said support means for rotatably supporting said spool;

crank means mechanically connected to said spool for rotating said spool and for paying out and reeling in said line; and stabilizer means attached to said support means and extending on opposite sides of and away from said spool and said crank means for straddling engagement with the tree, so that when the hunter rotates said crank means and said spool and the line of said spool lifts or lowers the hunter's gear, said stabilizer means maintains said support plate in a generally upright position and juxtaposed the adjacent surface of the tree, said stabilizer means being shaped for resisting movement of said winch about the tree; and a stabilizer bar extending downwardly from said support plate adjacent the tree for being secured to the tree and preventing said winch from pivoting and moving away from the tree while in operation.

12. The tree stand winch of claim 11 and wherein said support means comprises a substantially flat support plate, said spool being rotatably mounted to one side of said support plate and said crank means positioned on the other side of said support plate, and said attachment means including cleat means displaced from opposite sides of said support plate for removable engagement with a tree in straddling relationship for maintaining said support plate in a substantially right angle relationship with respect to the adjacent surfaces of the tree.

13. The tree stand winch of claim 11 and wherein said support means comprises two substantially flat parallel support plates, said spool being rotatably mounted between said support plates.

14. The tree stand winch of claim 11 and wherein said crank means includes a gear assembly for providing the hunter with lifting power.

15. The tree stand winch of claim 14 and wherein said gear assembly and said spool are mounted to the same side of said support plate.

16. A tree stand winch for mounting in a tree and for lifting and lowering hunter's gear comprising:

a support plate having an edge portion for facing a tree;

a spool rotatably mounted on one side of said support plate with a line wound about said spool;

a crank means mounted on the other side of said support plate for rotating said spool with respect to said support plate for paying out and reeling in said line for lifting and lowering the hunter's gear;

attachment means connected to said support plate for extending upwardly from said support plate and for suspending said support plate from the tree so that said support plate is parallel to the length of the tree;

stabilizer means mounted to said support plate and including tree engaging cleat means spaced on opposite sides of said support plate and extending from said support plate beyond said edge portion for straddling engagement with the tree and for securing said support plate in an upright position and with its edge portion in engagement with the tree, said stabilizer means being shaped for resisting movement of said winch about the tree;

a stabilizer bar extending downwardly from said support plate adjacent the tree; and means for securing said stabilizer bar to the tree for preventing said winch from pivoting and moving away from the tree.

* * * * *